US006254361B1

(12) United States Patent
Sabini

(10) Patent No.: US 6,254,361 B1
(45) Date of Patent: Jul. 3, 2001

(54) SHAFTLESS CANNED ROTOR INLINE PIPE PUMP

(75) Inventor: Eugene P. Sabini, Skaneateles, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/363,424

(22) Filed: Jul. 29, 1999

(51) Int. Cl.[7] ..... F04B 35/04

(52) U.S. Cl. ..... 417/423.14; 417/423.8; 417/423.14; 417/366; 417/370

(58) Field of Search ..... 417/423.14, 423.7, 417/423.8, 357, 366, 369–370

(56) References Cited

U.S. PATENT DOCUMENTS 4,806,080 * 2/1989 Mizobuchi et al. .
4,812,108 * 3/1989 Kotera ..... 417/368
5,149,253 * 9/1992 Miyamoto et al. ..... 417/353
5,332,374 * 7/1994 Kricker et al. ..... 417/420
5,405,251 * 4/1995 Sipin ..... 417/420
5,407,331 * 4/1995 Atsumi ..... 417/420
5,443,503 * 8/1995 Yamane ..... 623/3
5,501,582 * 3/1996 Gautier et al. ..... 417/420
5,547,350 * 8/1996 Rawal et al. ..... 417/354
5,713,727 * 2/1998 Veronesi et al. ..... 417/356
5,928,131 * 7/1999 Prem ..... 600/16

* cited by examiner

*Primary Examiner*—Charles G. Freay
*Assistant Examiner*—Robert Z. Evora
(74) *Attorney, Agent, or Firm*—M. J. Lombardi

(57) ABSTRACT

A pump having a generally hollow housing, an annular rotor rotatively mounted inside the housing, an annular stator fixedly mounted inside the housing and peripherally surrounding the rotor and a closed impeller axially aligned with the annular rotor. The impeller includes a tubular fluid inlet member fixedly mounted within the annular rotor, such that the rotor rotatively drives the impeller.

20 Claims, 4 Drawing Sheets

SHAFTLESS CANNED ROTOR INLINE PIPE PUMP

FIELD OF THE INVENTION

This invention relates to a canned rotor inline pipe pump and, more particularly, to a shaftless canned rotor inline pipe pump.

BACKGROUND OF THE INVENTION

Pumps are used in many applications for moving various types of fluids. For example, pumps are used in pipeline systems that supply water to boilers. Pumps are also used in pipeline systems that circulate cooling water for coolers and condensers and transferring fuel oil. Many chemical processes employ pumps in pipelines that circulate industrial chemicals in reactors, distribution columns, kettles and the like.

One commonly known pump for moving fluids in pipeline systems is a canned rotor (motor) inline pipe pump. A typical canned rotor inline pipe pump includes a motor positioned on one side of a pump. The motor has an enclosed or canned rotor with a drive shaft that is coupled to the pump's impeller for rotation thereof, and an enclosed or canned stator which peripherally surrounds the canned rotor. Fluid pumping is achieved through electromagnetic interaction between the canned rotor and the canned stator which produces high speed rotation of the rotor. The rotation of the rotor causes the impeller to rotate via the drive shaft which couples the impeller to the rotor.

Canned rotor pumps utilize a portion of the pump-treating fluid which is typically withdrawn from the suction port of the pump section and circulated through the motor to lubricate the motor and drive shaft bearings as well as remove heat which is generated due to the inefficiency of the motor. This portion of the fluid is then reintroduced into the suction port of the pump section.

There are some disadvantages associated with conventional canned rotor pumps. The drive shaft's bearings and other related mechanical components add complexity and increase the cost of such pumps. Further, the drive shaft and its related components can require a considerable amount of maintenance. Additionally, the drive shaft increases the length of the pump, thus limiting the available location of the pump in pipeline systems.

Pumps traditionally mounted on a baseplate can be subjected to many external forces and moments due to excessive pipe loads. These forces and moments can lead to premature pump failure. If the pump can reside within the piping system, all pipe loads will be eliminated.

Therefore, a need exits for a shaftless canned rotor inline pipeline pump.

SUMMARY OF THE INVENTION

A pump comprises a generally hollow housing, an annular rotor rotatively mounted inside the housing, an annular stator fixedly mounted inside the housing and peripherally surrounding the rotor and a closed impeller axially aligned with the annular rotor. The impeller includes a tubular fluid inlet member fixedly mounted within the annular rotor, such that the rotor rotatively drives the impeller.

BRIEF DESCRIPTION OF THE DRAWINGS

The advantages, nature and various additional features of the invention will appear more fully upon consideration of the illustrative embodiments now to be described in detail in connection with accompanying drawings wherein.

It should be understood that these drawings are for purposes of illustrating the concepts of the invention and are not to scale.

DETAILED DESCRIPTION OF THE INVENTION

Figure 1:
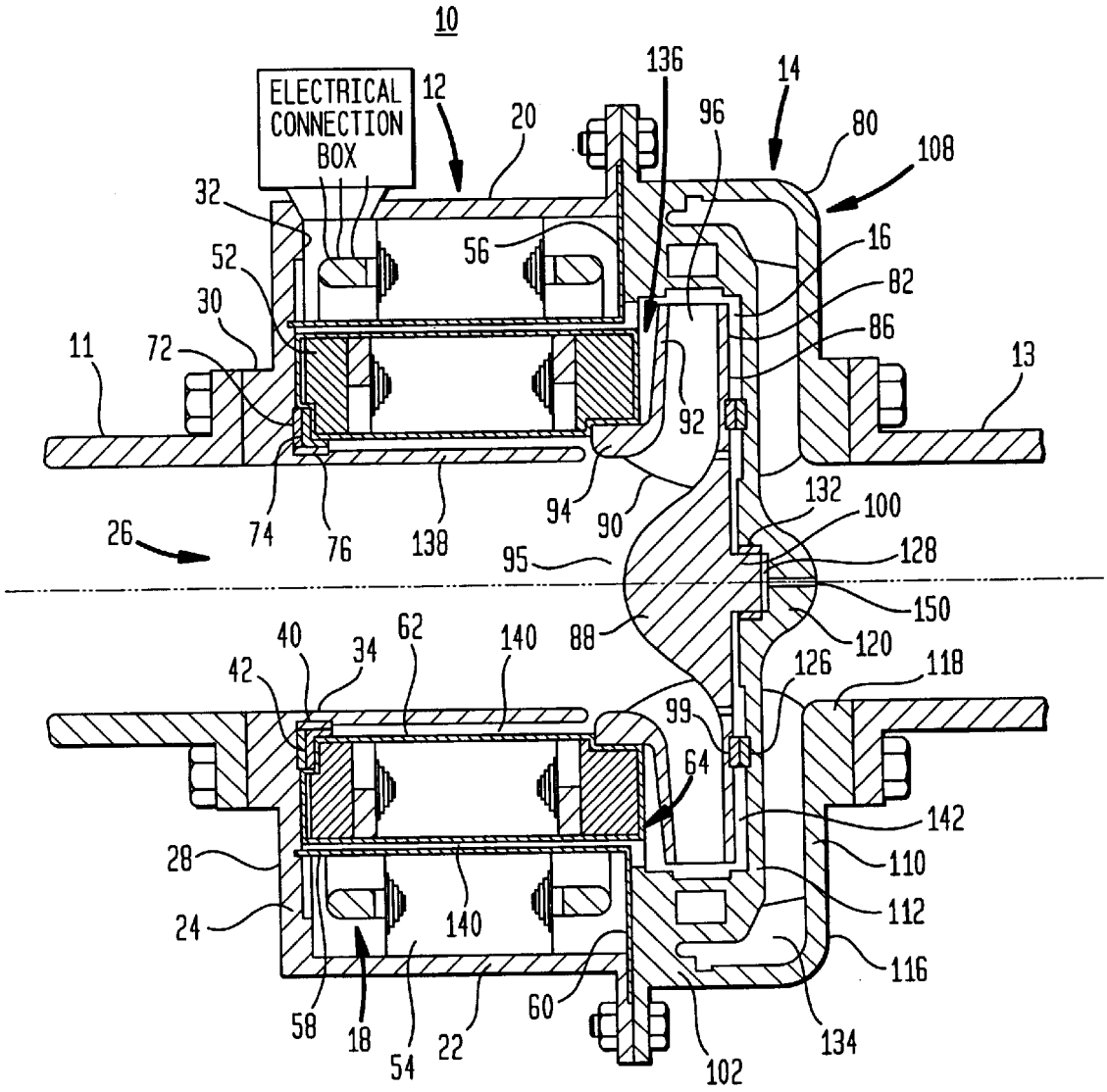
FIG. 1 is a sectional view of a pump according to an embodiment of the invention.

FIG. 1 shows a pump 10 according to an embodiment of the invention. The pump 10 is adapted as an inline pump for use in pipeline systems and installed between an inlet pipe 11 and an outlet pipe 13 of such a system. Since the pump 10 resides within the piping system, all pipe loads are substantially eliminated. Ordinary skilled artisans will recognize that the pump 10 can also be adapted for other applications as well.

As shown in FIG. 1, the pump 10 generally comprises a drive section 12 and a diffuser pump section 14 having an impeller 16 that is integral with the drive section 12 thus, eliminating the driveshaft used in conventional pumps. Eliminating the driveshaft advantageously reduces the mechanical complexity and maintenance requirements of the pump 10 and decreases its length, thus permitting the pump 10 to be positioned within a pipeline system in locations where conventional pumps can not be placed.

Figure 2:
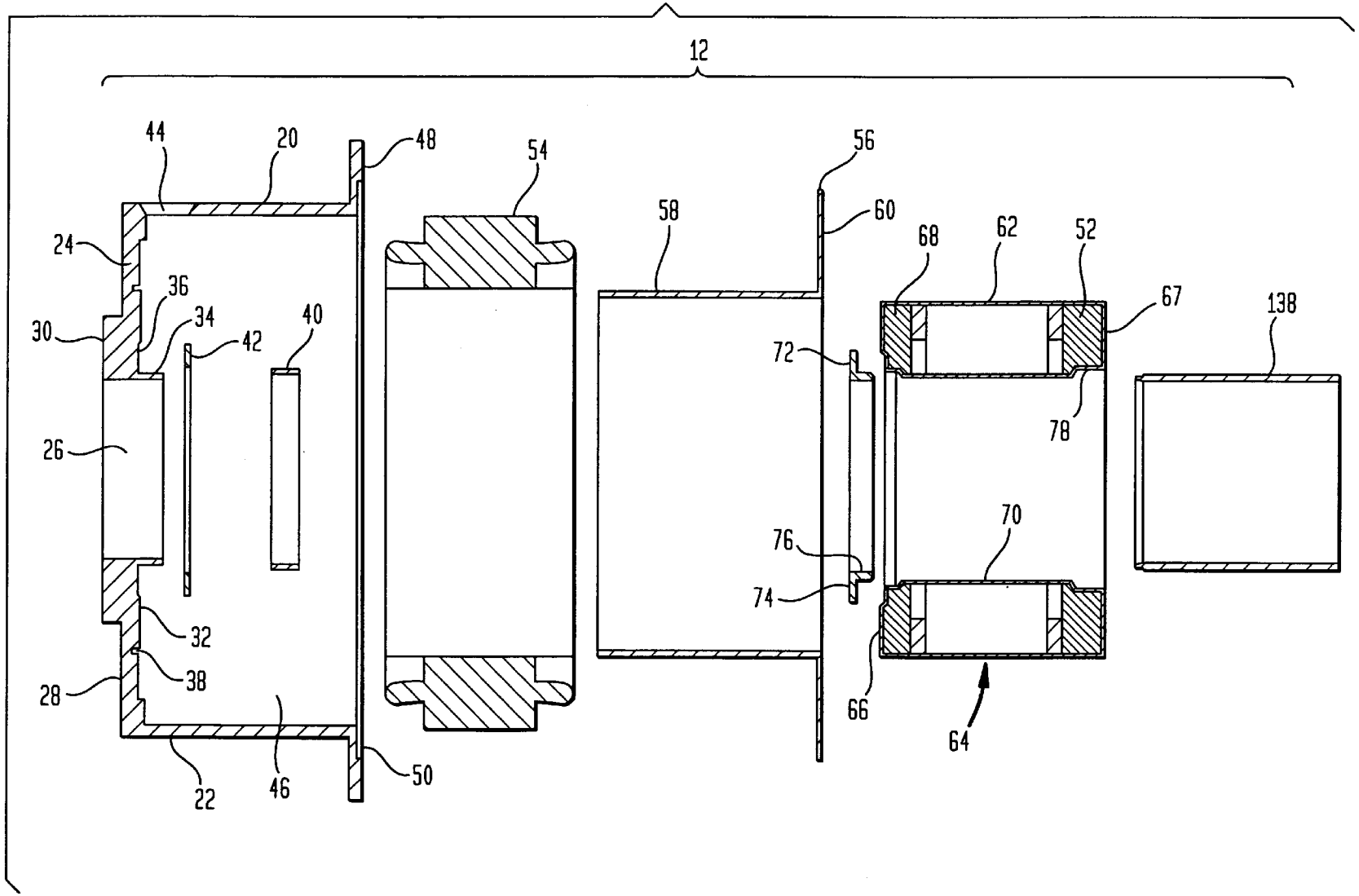
FIG. 2 is an exploded sectional view of the drive section of the pump of FIG. 1.

As collectively shown in FIGS. 1 and 2, the drive section 12 of the inventive pump 10 comprises a conventional motor 18 encased within a housing 20. The housing 20 generally includes a cylindrical sidewall 22 closed at one end by an endwall 24 having a fluid inlet opening 26. The outer surface 28 of the endwall 24 includes a raised circular inlet pipe mounting flange 30 surrounding the fluid inlet opening 26. The inner surface 32 of the endwall 24 defines a concentric arrangement of elements that includes a cylindrical flange 34 surrounding the fluid inlet opening 26, an annular recess 36 at the foot of the cylindrical flange 34, and an annular groove 38 that surrounds the cylindrical flange 34 and the annular recess 36. A cylindrical first rotor bearing 40 is fixedly mounted on the outer surface of the cylindrical flange 34, and a first annular rotor thrust bearing 42 is seated in the annular recess 36. The cylindrical sidewall 22 of the housing 20 includes an aperture 44 that communicates with the interior 46 of the housing 20 to permit electrical connection to the motor 18. The open end of the cylindrical sidewall 22 defines a circular mounting flange 48 for mounting the diffuser pump section 14 to the drive section 12. An annular relief 50 is provided on the inner periphery of the mounting flange 48.

The motor 18 of the drive section 12 can be an AC induction motor, a permanent magnet motor, a switch reluctance motor, or any other suitable motor capable of driving, a diffuser pump. In the shown embodiment, the motor 18 generally includes a rotor 52 rotatively mounted inside the housing 20, and a stator 54 fixedly mounted inside the housing 20, peripherally surrounding the rotor 52.

The stator 54 is constructed in an annular configuration and is typically hermetically sealed or canned by a stator enclosure 56 comprised of a cylindrical wall member 58 and an outwardly extending ring-shaped wall member 60. The free end 62 of the cylindrical wall member 58 is sealingly affixed in the annular groove 38 of the housing end wall 24 and the outermost portion of the ring-shaped wall member 60 sealingly resides in the annular relief 50 of the circular mounting flange 48 of the housing 20.

The rotor 52 is also constructed in an annular configuration and typically hermetically sealed or canned by a rotor enclosure 62 (canned rotor 64) that encases the rotor 52. The canned rotor 64 has first and second end surfaces 66, 67 and outer and inner cylindrical surfaces 68, 70 extending between the end surfaces 66, 67. A rotor bearing 72 is fixedly mounted to the portion of the canned rotor 64 where the first end surface 66 and the inner cylindrical surface 70 meet. The rotor bearing 72 has a second annular rotor thrust bearing member 74 seated on the first end surface 66 of the canned rotor 64, and a second cylindrical rotor bearing member 76 seated on the cylindrical inner surface 70 of the canned rotor 64. A shroud engagement recess 78 is formed in the inner cylindrical surface 70 of the canned rotor 64 adjacent the second end surface 67 thereof.

Figure 3:
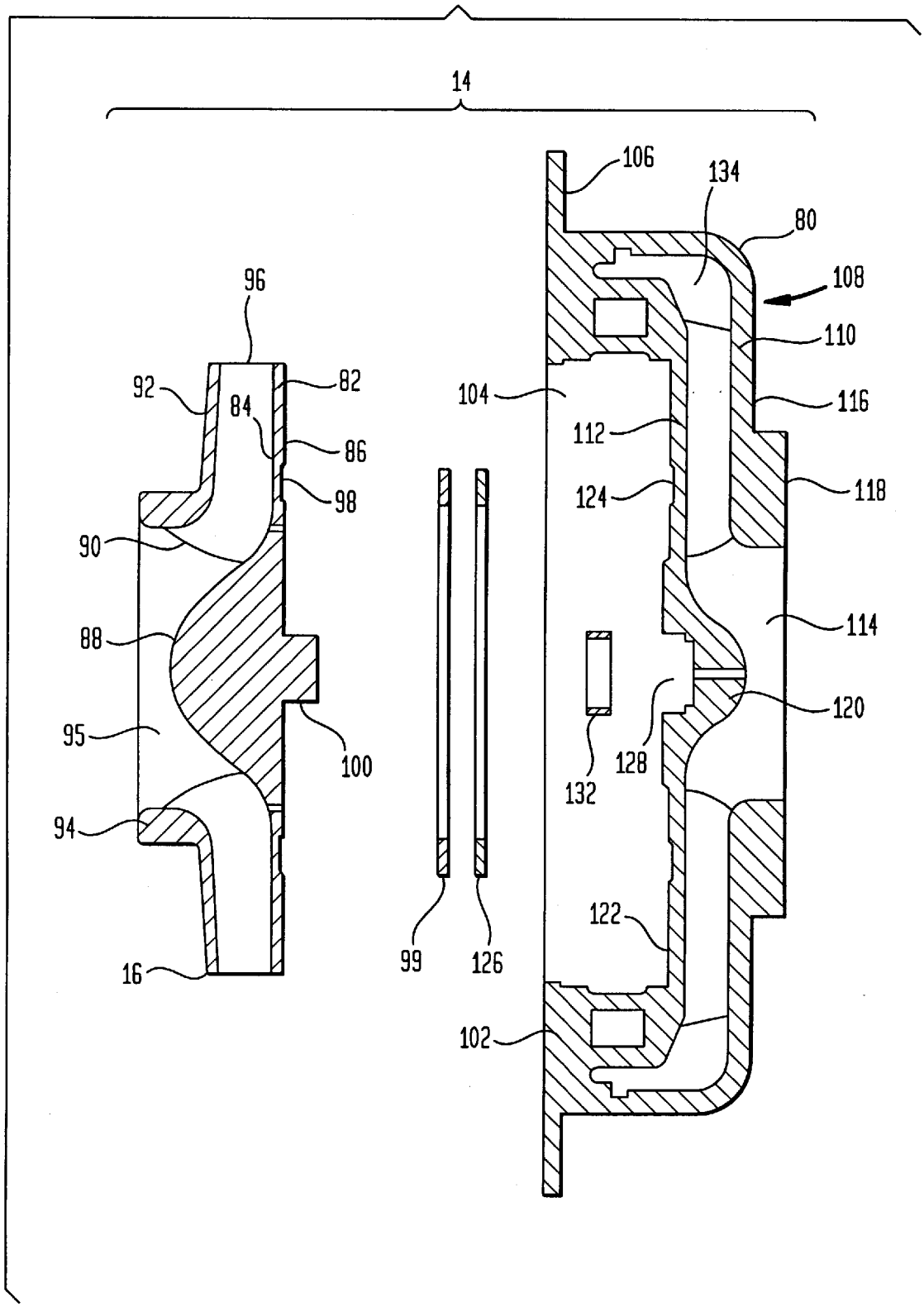
FIG. 3 is an exploded sectional view of the diffuser pump section of the pump of FIG. 1.

Referring collectively to FIGS. 1 and 3, the diffuser pump section 14 comprises the impeller 16 and a fluid collector or diffuser 80 fixedly mounted to the open end of the housing 20. The impeller 16 is typically constructed in a conventional closed configuration and comprises a disc member 82 with inner and outer surfaces 84, 86, a centrally disposed hub 88 emerging from the inner surface 84 thereof, a plurality of vanes 90 extending radially from the hub 88 on the inner surface 84 of the disc member 82, and a shroud 92 enclosing the vanes 90, the shroud 92 including a tubular inlet 94 defining an impeller inlet opening 95. The vanes 90 and shroud 92 define a plurality of conventional, radially extending impeller discharge ports 96. The outer surface 86 of the disc 82 includes an annular recess 98 that retains a first ring-shaped impeller thrust bearing 99, and a centrally disposed cylindrical pilot member 100.

The diffuser 80 comprises a cylindrical skirt 102 having an open end 104 with a circular mounting flange 106 that abuts against the mounting flange 48 of the housing 20, and a closed end 108 defined by circular outer and inner walls 110, 112. The outer wall 110 has a centrally disposed fluid outlet opening 114. The exterior surface 116 of the outer wall 110 includes a raised circular outlet pipe mounting flange 118 that surrounds the fluid outlet opening 114. The skirt 102 and walls 110, 112 define a plurality of conventional diffuser channel 134 that provide a fluid path between the impeller discharge ports 96 and the fluid outlet opening 114. The inner wall 112 has a centrally disposed hub member 120 which extends toward the fluid outlet opening 114 of the outer wall 110. The interior surface 122 of the inner wall 112 includes an annular recess 124 that retains a second ring-shaped impeller thrust bearing 126, and a centrally disposed pilot member receiving aperture 128. A cylindrical impeller bearing 132 is seated in a correspondingly shaped bearing seat 130 defined in the wall 129 of the pilot member receiving aperture 128.

As shown in FIG. 1, the shroud tubular inlet member 94 of the impeller 16 is nonrotatively seated in the engagement recess 78 of the canned rotor 64 thus, forming an integral canned rotor/impeller assembly 136. The canned rotor/impeller assembly is rotatively disposed between the housing 20 and the diffuser 80 with the canned rotor 64 mounted on the housing cylindrical flange 34 in axial alignment with the housing inlet opening 26 and the impeller 16 rotatively disposed in the diffuser 80 via the pilot member 100 and the pilot member receiving aperture 128. The rotor and the impeller bearings 40, 42, 72, 99, 126,132 permit free rotation of canned rotor/impeller assembly 136. Fluid pumping is achieved through electromagnetic interaction between the rotor 52 and the stator 54 which produces high speed rotation of the canned rotor/impeller assembly 136.

As further shown in FIG. 1, the pump 10 includes first and second fluid cooling/lubrication passageways 140 and 142. The first passageway 140 is formed by gaps defined between the canned stator 54 and the canned rotor 64, the canned rotor 64 and the housing end wall 24, and the canned rotor 64 and the tubular liner138. The second passageway is formed by a gap defined between the impeller 16 and the diffuser inner wall 112.

Figure 4:
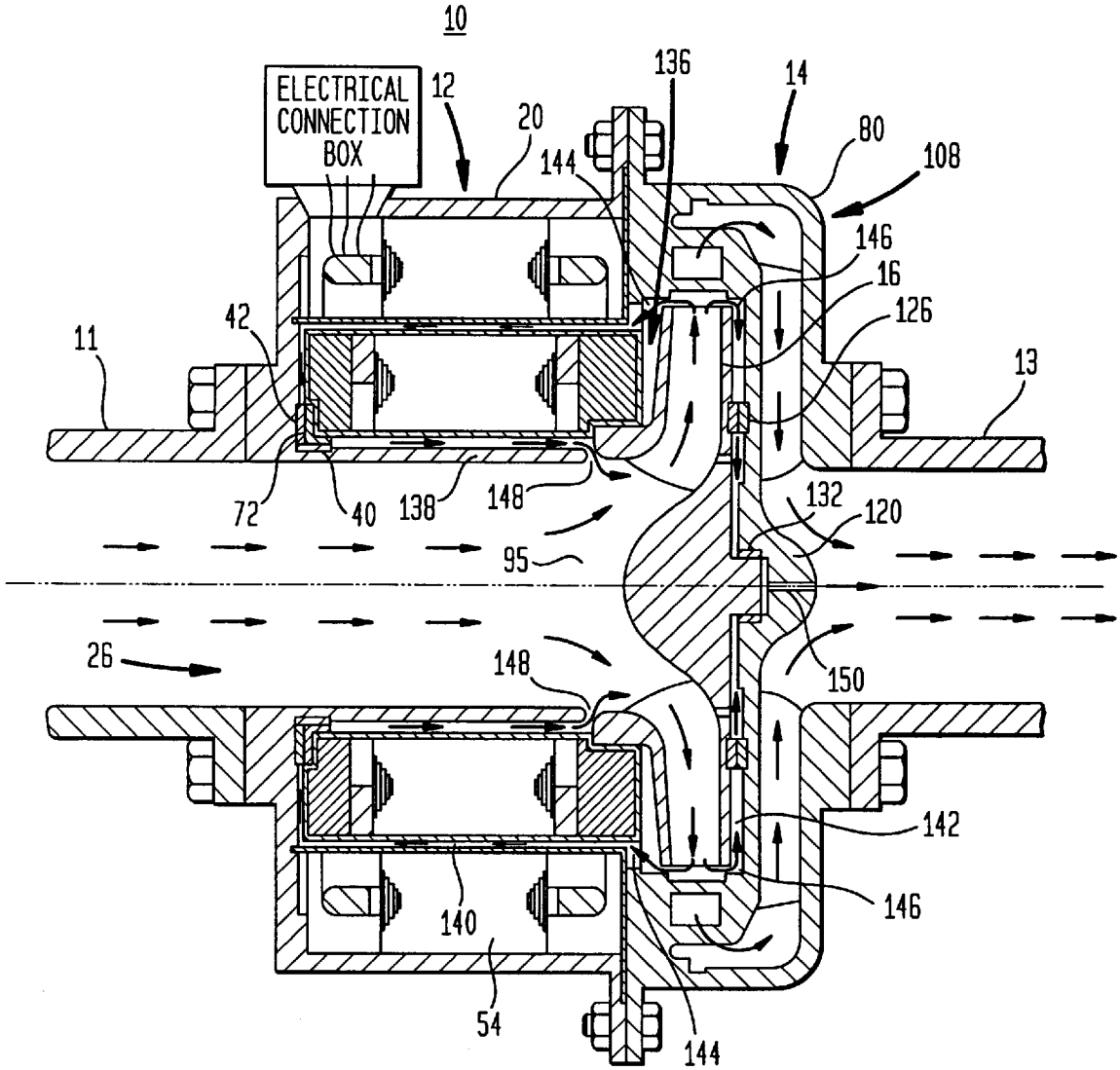
FIG. 4 is a sectional view of the pump of FIG. 1 showing fluid flow through the pump during operation thereof.

FIG. 4 shows fluid flow during operation of the pump 10. Fluid is drawn into the pump 10 through the housing inlet opening 26. A tubular liner 138 attached to the housing cylindrical flange 34, extends substantially through the canned rotor 64, aids in guiding the fluid into the impeller 16 and substantially eliminates any potential rotationally induced flow disturbances. The fluid enters the inlet 95 of the impeller 16 and is discharged through the impeller discharge ports 96. A portion of this discharged fluid enters the passageways 140, 142 at locations identified by numerals 144, 146. The fluid circulating through the passageways 140, 142 cools and lubricates the rotor and impeller bearings 40, 42, 72, 99, 126, 132 and also cools the stator 54 and canned rotor 64. The fluid circulating in the first passageway 140 exits at a location identified by numeral 148 and reenters the impeller inlet 96. The fluid circulating in the second passageway 142 exits via an aperture 150 in the diffuser hub 120 for discharged through the fluid outlet opening 114. The remaining portion of the discharged fluid is directed through the diffuser 80 and discharges axially through the fluid outlet opening 114.

While the foregoing invention has been described with reference to the above embodiment, various modifications and changes can be made without departing from the spirit of the invention. Accordingly, all such modifications and changes are considered to be within the scope of the appended claims.

What is claimed is:

1. A pump comprising:

a generally hollow housing;

an annular rotor rotatively mounted inside the housing;

an annular stator fixedly mounted inside the housing and peripherally surrounding the rotor; and a closed impeller axially aligned with the annular rotor, the impeller including a tubular fluid inlet member fixedly mounted to the annular rotor, the rotor rotatively driving the impeller.

2. The pump according to claim 1, further comprising a fluid collector fixedly mounted to the housing and encasing the impeller.

3. The pump according to claim 2, wherein the housing includes a circular flange extending from an inner surface thereof, the annular rotor rotatively mounted on the circular flange.

4. The pump according to claim 2, wherein the impeller further includes a pilot pin rotatively disposed in an aperture of the fluid collector.

5. The pump according to claim 2, wherein the fluid collector includes a fluid outlet opening which defines a pump outlet.

6. The pump according to claim 1, wherein the housing includes a fluid inlet opening that defines a pump inlet, the fluid inlet opening of the housing is axially aligned with the rotor.

7. The pump according to claim 6, wherein the fluid collector includes a fluid outlet opening that defines a pump outlet.

8. The pump according to claim 7, wherein the fluid outlet opening of the fluid collector is axially aligned with the rotor and the fluid inlet opening of the housing.

9. The pump according to claim 1, wherein the rotor and the stator are both hermetically sealed.

10. A pump comprising:

a generally hollow housing;

an annular rotor rotatively mounted inside the housing;

an annular stator fixedly mounted inside the housing and peripherally surrounding the rotor; and a closed impeller axially aligned with the annular rotor, the impeller including a tubular fluid inlet member fixedly mounted to the annular rotor and a plurality of radially extending impeller discharge ports communicating with the fluid inlet member, the rotor rotatively driving the impeller; and a fluid collector fixedly mounted to the housing and encasing the impeller, the fluid collector communicating with the discharge ports of the impeller.

11. The pump according to claim 10, wherein the impeller further includes a pilot pin rotatively disposed in an aperture of the fluid collector and the housing includes a circular flange extending from an inner surface thereof, the annular rotor rotatively mounted on the circular flange.

12. The pump according to claim 11, further comprising a first bearing disposed between the inner periphery of the rotor and the circular flange and a second bearing disposed between the pilot pin and the aperture.

13. The pump according to claim 10, further comprising a thrust bearing disposed between axially opposing surfaces of the impeller and the fluid collector and a second thrust bearing disposed between axially opposing surfaces of the rotor and an inner surface of the housing.

14. The pump according to claim 10, wherein housing includes a fluid inlet opening that defines a pump inlet and the fluid collector includes a fluid outlet opening that defines a pump outlet.

15. The pump according to claim 14, wherein the fluid outlet opening of the fluid collector is axially aligned with the rotor and the fluid inlet opening of the housing.

16. The pump according to claim 10, wherein the rotor and the stator are both hermetically sealed.

17. A pump comprising:

a generally hollow housing having a fluid inlet opening that defines a pump inlet;

a hermetically sealed annular rotor rotatively mounted inside the housing;

a hermetically sealed annular stator fixedly mounted inside the housing and peripherally surrounding the rotor; and a closed impeller axially aligned with the annular rotor, the impeller including a tubular fluid inlet member fixedly mounted to the annular rotor and a plurality of radially extending impeller discharge ports communicating with the fluid inlet member, the rotor rotatively driving the impeller; and a fluid collector fixedly mounted to the housing and encasing the impeller, the fluid collector communicating with the discharge ports of the impeller and including a fluid outlet opening that defines a pump outlet.

18. The pump according to claim 17, wherein the impeller further includes a pilot pin rotatively disposed in an aperture of the fluid collector and the housing includes a circular flange extending from an inner surface thereof, the annular rotor rotatively mounted on the circular flange.

19. The pump according to claim 18, further comprising a first bearing disposed between the inner periphery of the rotor and the circular flange and a second bearing disposed between the pilot pin and the aperture.

20. The pump according to claim 17, further comprising a thrust bearing disposed between axially opposing surfaces of the impeller and the fluid collector and a second thrust bearing disposed between axially opposing the rotor and an inner surface of the housing.

* * * * *